US010835057B1

(12) United States Patent
Keogh et al.

(10) Patent No.: US 10,835,057 B1
(45) Date of Patent: Nov. 17, 2020

(54) CONFECTIONARY DISPLAY APPARATUS

(71) Applicants: Geraldine Keogh, Stilling, NJ (US); Lindsay Smith, Mendham, NJ (US)

(72) Inventors: Geraldine Keogh, Stilling, NJ (US); Lindsay Smith, Mendham, NJ (US)

(73) Assignee: GPK ENTERPRISES, Scotch Plains, NJ (US)

( * ) Notice: Subject to any disclaimer, the term of this patent is extended or adjusted under 35 U.S.C. 154(b) by 0 days.

(21) Appl. No.: 16/397,834

(22) Filed: Apr. 29, 2019

(51) Int. Cl.
*A47F 5/06* (2006.01)
*A47F 7/00* (2006.01)

(52) U.S. Cl.
CPC ..... *A47F 5/06* (2013.01); *A47F 7/0071* (2013.01)

(58) Field of Classification Search
CPC ..... A47F 5/06; A47F 7/0071
See application file for complete search history.

(56) References Cited

U.S. PATENT DOCUMENTS

D22,569 S * 6/1893 Yearous ..... D6/680
1,047,882 A * 12/1912 Beach ..... A47B 3/12 108/101
1,595,449 A * 8/1926 Carrm ..... A47F 5/025 211/1.53
2,112,879 A 4/1938 Broderick
2,318,081 A * 5/1943 Kerry ..... B25H 3/04 211/70.6
2,697,294 A * 12/1954 Zenker ..... G09F 19/10 40/539
2,946,456 A * 7/1960 Liguori ..... A47F 7/283 211/77
3,197,096 A * 7/1965 Marcocchio ..... B65H 49/28 223/107
3,613,901 A * 10/1971 Montelius ..... A47F 5/05 211/166
4,011,954 A * 3/1977 Galli ..... A47F 5/04 211/14
4,132,457 A 1/1979 Parrish et al.
4,253,561 A 3/1981 Fontlladosa
D269,771 S * 7/1983 Williams ..... D11/118
(Continued)

FOREIGN PATENT DOCUMENTS

EP 1 493 362 B1 1/2005
FR 2854557 A1 * 11/2004 ..... A47F 5/06
FR 3027501 A1 * 4/2016 ..... A47F 5/04

OTHER PUBLICATIONS

International Search Report dated Sep. 14, 2020 issued in PCT/US20/30471; 3 pages.
(Continued)

*Primary Examiner* — Stanton L Krycinski
(74) *Attorney, Agent, or Firm* — Gearhart Law LLC

(57) ABSTRACT

A confectionary display apparatus is described. The confectionary display includes a top, middle layer(s) and a bottom layer. Insertion component(s) are attached to the top, middle, and bottom layer(s). A confectionary is insertable to an insertion component. A display component is also attached to the top layer. The display component is configured to receive a label. The confectionary display apparatus also includes a base and a protective cover. The base is attached to the top, one or more middle, and the bottom layers with a shaft. The protective cover is attachable to the base.

18 Claims, 3 Drawing Sheets

(56) References Cited

U.S. PATENT DOCUMENTS 4,628,580 A * 12/1986 Gowan ..... B25H 3/00 29/428
4,632,474 A * 12/1986 Ingersoll ..... A47F 7/02 312/125
4,678,089 A * 7/1987 Lang ..... A47B 57/26 211/133.4
4,746,022 A * 5/1988 Benham ..... A47F 5/04 211/195
4,892,197 A * 1/1990 Slattery ..... A47F 5/025 211/129.1
D317,838 S * 7/1991 Millet ..... D6/661.3
5,094,348 A * 3/1992 Harris ..... A47B 87/00 211/194
D325,483 S * 4/1992 Muhlack ..... D6/661.3
5,337,904 A * 8/1994 Goldberg ..... A47F 5/04 211/26.1
5,413,801 A * 5/1995 McIlwain ..... A23G 3/50 211/126.2
5,487,600 A * 1/1996 Griffin ..... A47F 3/10 211/129.1
5,702,742 A 12/1997 Jones
5,772,050 A * 6/1998 Shih ..... B41K 1/58 211/163
D403,558 S * 1/1999 Martinez ..... D7/610
6,520,352 B2 * 2/2003 Mondragon ..... A47F 5/02 211/129.1
6,715,622 B2 * 4/2004 Keenan ..... A47F 7/0071 211/205
7,144,610 B1 * 12/2006 Estes ..... A47B 97/00 428/19
7,584,973 B2 * 9/2009 Brager ..... B25H 3/026 108/141
D601,365 S * 10/2009 LaValley ..... D6/677.1
D641,570 S * 7/2011 Zieman ..... D3/25
D665,197 S * 8/2012 Allameh ..... D6/661.3
D667,240 S * 9/2012 Weldon ..... A47G 33/004 D6/661.3
8,770,419 B2 * 7/2014 Carlton ..... A47F 7/0028 211/70.6
9,107,514 B1 * 8/2015 Morieras ..... A47F 7/02
9,585,476 B2 * 3/2017 Swisher ..... A47B 97/00
9,833,051 B2 * 12/2017 Chinlund ..... A45C 11/16
9,839,304 B2 * 12/2017 Liao ..... A47F 5/0018
D836,719 S * 12/2018 Smith ..... D19/85
10,189,634 B2 * 1/2019 Elgamal ..... B65D 85/36
10,213,041 B1 * 2/2019 Fonseca ..... A47G 33/06
10,477,990 B2 * 11/2019 Seba Raffoul ..... A47F 5/108
2005/0019451 A1 1/2005 Margiotta
2012/0118841 A1 * 5/2012 West ..... A47F 7/0071 211/85.4
2013/0136829 A1 * 5/2013 Kandel ..... A47G 19/00 426/132
2014/0091087 A1 * 4/2014 Vollano ..... A47J 47/14 220/4.27
2014/0339185 A1 * 11/2014 Ellison ..... A47F 5/04 211/119.003
2017/0065104 A1 * 3/2017 Metropulos ..... A47J 37/049
2017/0303707 A1 * 10/2017 McSorley ..... A47G 19/00
2018/0020682 A1 * 1/2018 Bullard ..... A21C 15/00 426/273

OTHER PUBLICATIONS

Written Opinion dated Sep. 14, 2020 issued in PCT/US20/30471; 10 pages.

Ienjoyware, Tier Hexagonal Dessert Cake Stand (T-Shaped Handle-Gold), Oct. 14, 2018 [online], [retrieved Jul. 18, 2020] Retrieved from the Internet <URL:https://www.amazon.com/Tier-Hexagonal-Stand-T-Shaped-Handle/dp/B07JFNQ32W/ref=sr_1_5?dchild=1&keywokrs=hexagonal+cake+stand&qid=1595339120&sr=8-5>, title, first page, image.

Gourmet Kitchen, PL8 Cupcake Carrier & Display PL8 5200, May 5, 2012 [online], [retrieved on Jul. 18, 2020]. Retrieved from the internet <https://www.amazon.com/Barski-European-Handmade-Diameter-Europe/dp/B07F4557BS/ref=asc_df_B07F4557BS/?tag=bingshoppinga-20&linkCode=df0&hvadid=&hvpos=&hvnetw=o&hvrand=&hvpone=&hvptwo=&hvqmt=e&hvdev=c&hvdvcmd1=&hvlocint=&hvlocphy=&hvtargid=pla-4584345015731429&psc=1>; first page, image.

Barkski, European—Handmade Glass—Cake Dome 11" Diameter—Made in Europe, [online], [retrieved on Jul. 20, 2020] Retrieved from the Internet <URL:https://www.amazon.com/Barski-European-Handmade-Diameter-dchild=1&hvadid=78340258015711&hvbmt=bb&hvdev=c&hvqmt=b&keywords=barski+european+glass&qid=1600693586&sr=8-53>, first page, image.

* cited by examiner

CONFECTIONARY DISPLAY APPARATUS

CLAIM OF PRIORITY

This application is a non-provisional application and claims no priority to any patent or patent application.

FIELD OF THE EMBODIMENTS

The field of embodiments of the present invention is related to a confectionary holder and packaging apparatus.

BACKGROUND OF THE EMBODIMENTS

Baked goods are favored treats. In particular, desserts are items of desire. Desserts are sought after for consumption. When displayed, the desserts create a demand and increase sale value to appeal created by desirability. A problem that comes with display of desserts is related to fragility. Display of desserts in a multi layered and appealing mechanism while securing for transportation is a complicated problem to solve. Many solutions attempt but come up short of securing multiple layered treats in an appealing display mechanism.

For instance, EP1493362A1 pertains to a plate provided with rods to receive pastry pieces. The plate has bores to permit an immovable fixation of the plate on junction node either directly or by an intermediary of a connection shaft. The node has tight contours for detachable joining on one of the plates. The connection shaft has two ends for interlocking the plate and the junction node, respectively. An independent claim is also included for a volumetric structure constituted of a support structure forming assembly.

FR2443820A1 pertains to a display unit with feet of the type including/understanding a vertical post and at least a rod of suspension supported by the aforementioned post. The invention, such as a display unit is characterized in that post includes/understands at least two lines of holes which extend each one according to a vertical line, in what the display unit is composed of at least three vertical posts and in what the rods of suspension are adapted to cross the holes of the posts, with the wished height, purposes to assemble the posts between them by bracing. Application to the presentation of clothing in the stores of clothes industry, the windows and the boutiques.

FR2195904A5 pertains to a display stand made up of an upper domed portion, a bottom bowl-shaped portion and intermediate support discs and spacers. These discs and spacers are removable, and the upper and bottom portions can then be fitted together to form an autonomous holder.

U.S. Pat. No. 5,984,112A pertains to a golf ball holder for displaying golf balls. The golf ball holder is manufactured from a thermoplastic material. The holder is manufactured to accommodate from a single golf ball to an infinite number. A base portion supports the holder and the golf ball holder terminates in a top portion that seats a single golf ball. A side display portion extends from the base portion to the top portion and has a plurality of openings formed therein for receiving and retaining golf balls therein.

However, none of the art described above addresses all the issues that the embodiments of the present invention do.

SUMMARY OF THE EMBODIMENTS

Embodiments of the present invention include a confectionary display apparatus. The confectionary display apparatus may include a top, middle, and bottom layers. The top, middle, and bottom layer(s) may be attached to insertion component(s). Confectionary(s) may be insertable to the insertion component(s). The confectionary display apparatus may also include a display component attached to the top layer. The display component may be configured to receive a label. The confectionary display apparatus may also include a base. The base may be attached to the top, middle, and bottom layers with a shaft.

Embodiments also include another confectionary display apparatus. The confectionary display apparatus may include a top, middle, and bottom layers. The top, middle, and bottom layer(s) may be attached to insertion component(s). Confectionary(s) may be insertable to the insertion component(s). A primary size of the top layer may be less than secondary size(s) of the middle layer(s), and secondary size(s) of the middle layer(s) are less than a tertiary size of the bottom layer. The confectionary display apparatus may also include a display component attached to the top layer. The display component may be configured to receive a label. The confectionary display apparatus may also include a base. The base may be attached to the top, middle, and bottom layers with a shaft.

Embodiments include yet another confectionary display apparatus. The confectionary display apparatus may include a top, middle, and bottom layers. The top, middle, and bottom layer(s) may be attached to insertion component(s). Confectionary(s) may be insertable to the insertion component(s). A primary size of the top layer may be less than secondary size(s) of the middle layer(s), and secondary size(s) of the middle layer(s) are more than a tertiary size of the bottom layer. The confectionary display apparatus may also include a display component attached to the top layer. The display component may be configured to receive a label. The confectionary display apparatus may also include a base. The base may be attached to the top, middle, and bottom layers with a shaft.

Furthermore, embodiments include a confectionary transport system. The confectionary transport system may include a confectionary display apparatus and a protective cover. The confectionary display apparatus may include a top, middle, and bottom layers. The top, middle, and bottom layer(s) may be attached to insertion component(s). Confectionary(s) may be insertable to the insertion component(s). The confectionary display apparatus may also include a display component attached to the top layer. The display component may be configured to receive a label. The confectionary display apparatus may also include a base and a protective cover. The base may be attached to the top, middle, and bottom layers with a shaft. The protective cover may be attachable to the base. The protective cover may include a shape that encompasses the display component, the top, middle, and bottom layers It is an object of the embodiment of the present invention to provide a confectionary display apparatus.

It is another object of the embodiment of the present invention to provide a multi layered stand that holds and presents confection(s).

It is another object of the embodiment of the present invention to include display component(s) that present insertable label(s).

It is yet another object of the embodiment of the present invention to provide a confectionary display in a cone shape.

It is yet another object of the embodiment of the present invention to provide a confectionary display in a sphere shape.

In addition to the foregoing, other objects, features, aspects and advantages of the present invention will be better comprehended through a careful reading of a detailed description provided herein below with appropriate reference to the accompanying drawings.

DESCRIPTION OF THE PREFERRED EMBODIMENTS

Figure 1:
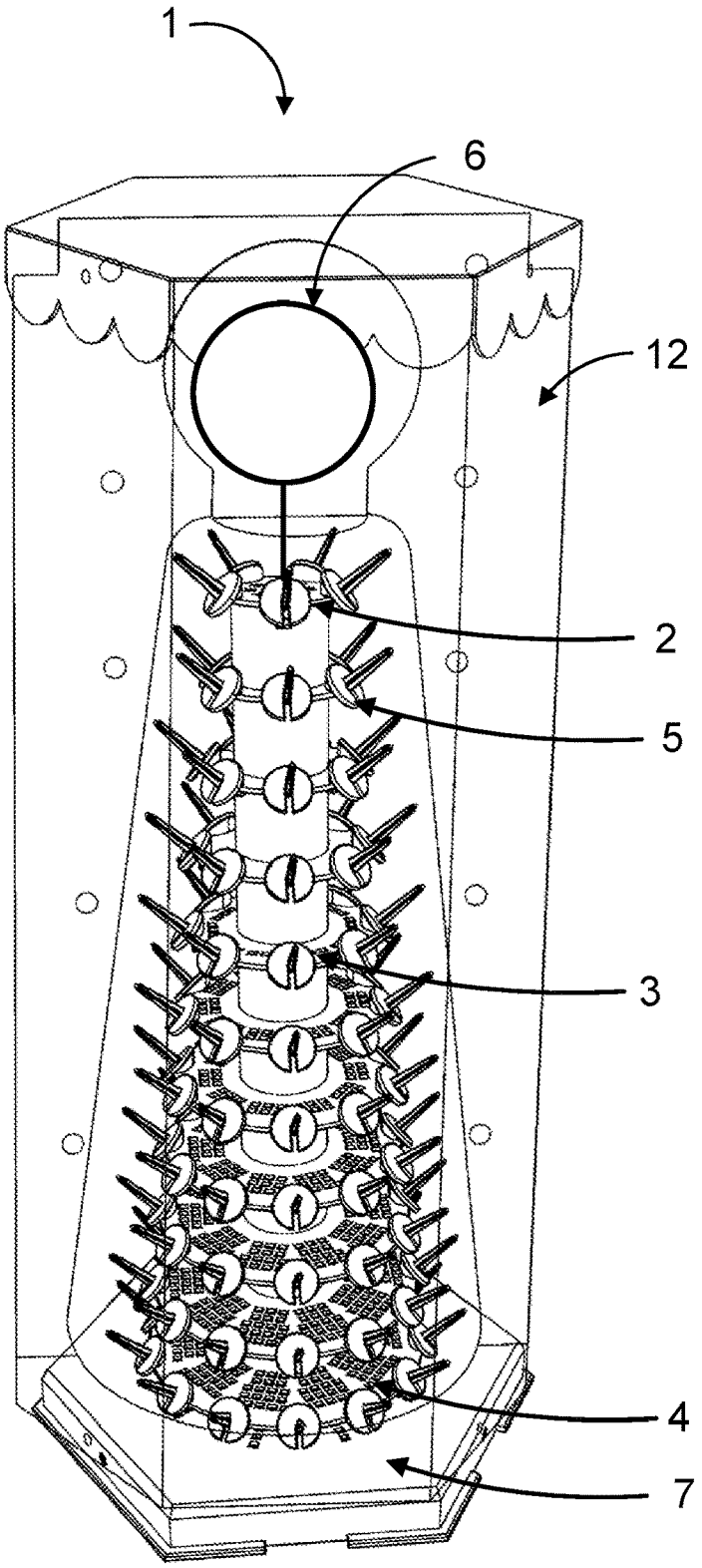
FIG. 1 shows a high-level view of the confectionary display apparatus.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As seen in FIG. 1, the present invention may include a confectionary display apparatus 1. The confectionary display apparatus 1 may include a carrier mechanism to securely and safely display, store, and transport confectionary. Confectionary such as cake based baked goods or candy-based consumables may be fragile and subject to breakage upon minor contact or movement. As such, the confectionary display apparatus 1 may provide a mechanism to secure, transport, and display confectionary(s). Furthermore, a protective cover 12 may be used to additionally secure the confectionaries on the confectionary display apparatus 1. The protective cover 12 and the confectionary display apparatus 1 may comprise a confectionary transport system.

In an example scenario, the confectionary display apparatus 1 may include several layers. For example, the confectionary display apparatus 1 may include a top layer 2, middle layer(s) 3, and a bottom layer 4. The confectionary display apparatus 1 may also include a base 7 that supports the top, middle, and bottom layers (2, 3, and 4). A carrier mechanism made of the top, middle, and bottom layers (2, 3, and 4) and the base 7 may include a variety of shapes. An example of the carrier mechanism may include a cone-based shape. Another example of the stand may include a spherical shape.

The top, middle, and bottom layers (2, 3, and 4) may each have cylindrical shapes. Furthermore, insertion component(s) may be attached to each of the top, middle, and bottom layers (2, 3, and 4). Confectionary(s) may be insertable to the insertion component(s). The insertion component(s) may secure the confectionary(s) in place upon insertion. The inserted confectionaries may imitate the shape of the carrier mechanism made of the top, middle, and bottom layers. As such, the inserted confectionaries may look like a cone or a sphere, among other shapes.

The confectionary display apparatus 1 may also include a display component 6, the display component 6 may be attached to the top layer 2. The display component 6 may be configured to receive label(s).

Furthermore, the confectionary display apparatus 1 and a protective cover 12 may comprise the confectionary transport system. The protective cover 12 may be attachable to the base 7 of the confectionary display apparatus 1. The protective cover 12 may include a shape that encompasses the display component 6, the top, middle, and bottom layers (2, 3, and 4).

Figure 2:
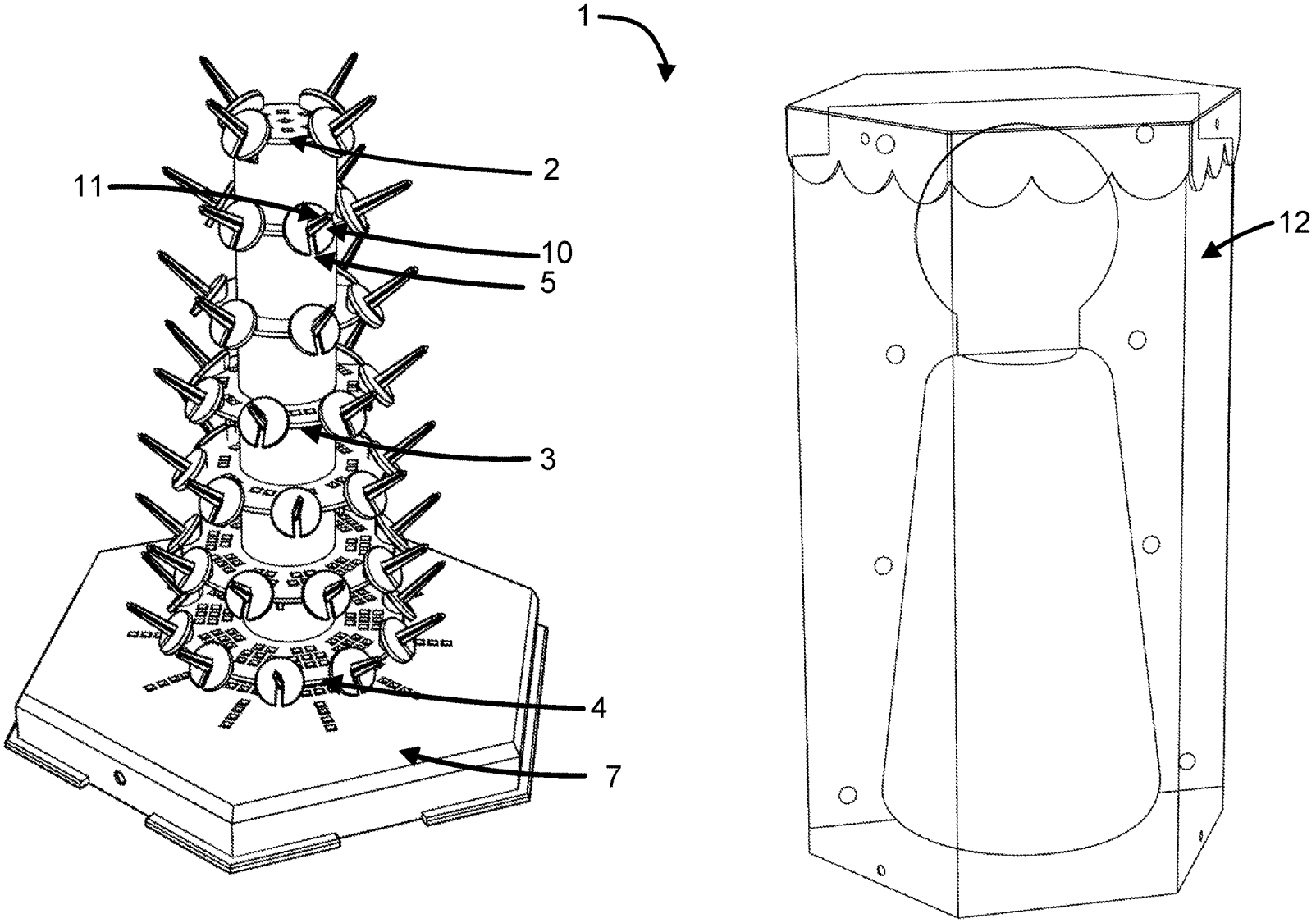
FIG. 2 shows a detailed view of an embodiment of the confectionary display apparatus.

FIG. 2 shows a detailed view of the confectionary display apparatus 1 that has a cone shape. In an example scenario, the confectionary display apparatus 1 may include top, middle, and bottom layers (2, 3, and 4). The top, middle, and bottom layers (2, 3, and 4) may be attached to a shaft 9 which may secure the top, middle, and bottom layers (2, 3, and 4) to the base 7.

The top, middle, and bottom layers (2, 3, and 4) may include a circular shape. To provide the confectionary display apparatus 1 with the cone shape, a primary size of the top layer 2 may be less than secondary sizes of the middle layers 3. The secondary sizes of the middle layers 3 may be less than a tertiary size of the bottom layer 4. The secondary sizes of the middle layer 4 may gradually increase from a direction of the top layer 2 to the bottom layer 4 in order to provide the cone shape of the confectionary display apparatus 1.

Each of the top, middle, and bottom layers (2, 3, and 4) are attached to insertion components 5 at respective circumferences. The insertion components 5 may be the primary mechanism to secure confectionary(s). A number of the insertion components 5 may be distributed evenly around the circumferences of the top, middle, and/or bottom layers (2, 3, and 4). The number of the insertion components 5 may increase or decrease based on an increase or decrease in a size of the top, middle, and/or bottom layers (2, 3, and 4) in a comparison to a previous layer. Furthermore, a distribution pattern of the insertion components 5 may be varied based on demands associated with a shape of the confectionary display apparatus 1.

In an example scenario, the insertion component 5 may include a stick 11 and a circular base 10. The stick 11 may be positioned at a center of the circular base 10. The stick 11 may point out of the circular base 10 at a tangent in relation to a plane of the circular base 10. For example, a confection may be insertable to the stick 11. The circular base 10 may be configured to hold the confection in place by stopping the confection from further traveling down the stick 11. The circular base 10 may be attached to the top, middle, or bottom layers (2, 3, or 4) at an angle. The angle may prevent the confection from slipping out of the stick 11 when the base 7 of the confectionary display apparatus 1 is parallel to a plane of the ground (and the top layer 2 is facing away from the ground). Furthermore, when inserted to the insertion components 5, the confectionary may adapt the shape of the confectionary display apparatus 1.

In another example scenario, the base 7 may include a hexagonal shape. A protective cover 12 of the confectionary transport system may have a shape that is attachable to the base 7 of the confectionary display apparatus 1. The protective cover 12 may include a shape that encompasses the display component 6 (as shown in FIG. 1), the top, middle, and bottom layers (2, 3, 4), and the base 7. For example, an external surface of the protective cover 12 may include a three-dimensional hexagonal shape. An internal surface of the protective cover 12 may include a cone shape to encompass the confectionary display apparatus 1. Furthermore, the protective cover 12 may be transparent to allow visual inspection of the confectionary inserted to the confectionary display apparatus 1.

Figure 3:
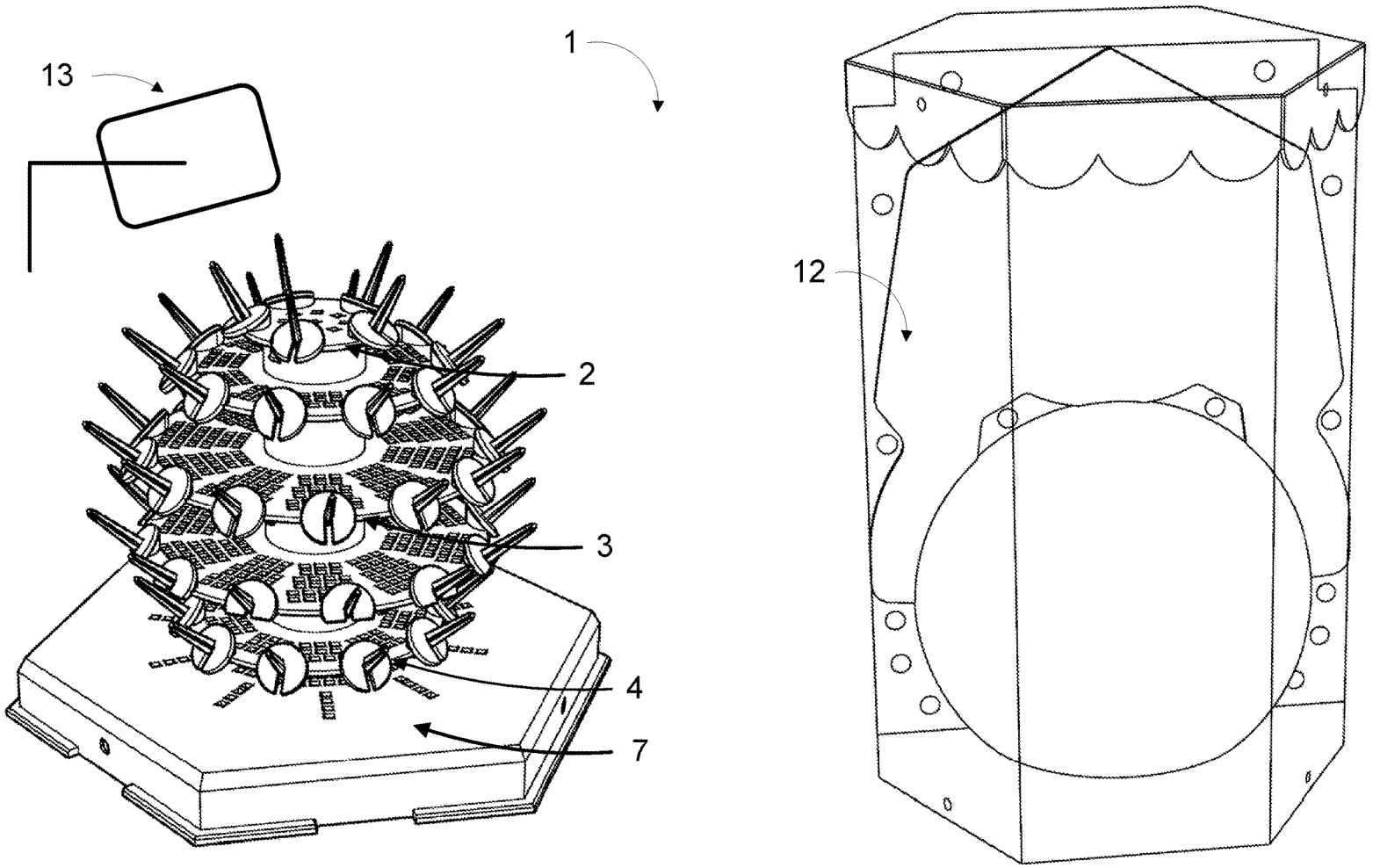
FIG. 3 shows a detailed view of another embodiment of the confectionary display apparatus.

FIG. 3 shows a detailed view of the confectionary display apparatus 1 that includes a spherical shape. In an example scenario, to provide the spherical shape, a primary size of the top layer 2 may be less than secondary sizes of the one or more middle layers 3. The secondary sizes of the middle layers 3 may be more than a tertiary size of the bottom layer 4. The top, middle, and bottom layers (2, 3, and 4) may be attached to the base 7 with a shaft. Furthermore, an attachable label display 13 may be insertable to the top, middle, or bottom layers (2, 3, or 4). The attachable label display 13 may be configured to receive label(s).

The confectionary display apparatus 1 may be secured with the protective cover 12 to provide the confectionary transport system. The protective cover 12 may include a shape that encompasses the top, middle, bottom layers (2, 3, and 4), the base, and/or the display component 6 (as shown in FIG. 1). An external surface of the protective cover 12 may include a three-dimensional hexagonal shape. An internal surface of the protective cover 12 may include a spherical shape.

In addition to the foregoing, other objects, features, aspects and advantages of the present invention will be better comprehended through a careful reading of a detailed description provided herein below with appropriate reference to the accompanying drawings.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A confectionary display apparatus comprising:
- a top layer, wherein
  - the top layer is coupled to one or more first insertion components, and wherein
  - one or more first confectionaries are insertable to the one or more first insertion components;
- one or more middle layers, wherein
  - the one or more middle layers are coupled to one or more second insertion components, and wherein
  - one or more second confectionaries are insertable to the one or more second insertion components;
- a bottom layer, wherein
  - the bottom layer is coupled to one or more second insertion components, and wherein
  - one or more third confectionaries are insertable to the one or more third insertion components;
- a removable display component coupled to the top layer, wherein the display component is configured to receive one or more labels; and
- a base, wherein the base is coupled to the top, one or more middle and bottom layers with a shaft.

2. The confectionary display apparatus of claim 1, wherein the top layer, the one or more middle layers, and the bottom layer have a circular shape.

3. The confectionary display apparatus of claim 2, wherein a primary size of the top layer is less than one or more secondary sizes of the one or more middle layers, and wherein the one or more secondary sizes of the one or more middle layers are less than a tertiary size of the bottom layer.

4. The confectionary display apparatus of claim 2, wherein a primary size of the top layer is less than one or more secondary sizes of the one or more middle layers, and wherein the one or more secondary sizes of the one or more middle layers are more than a tertiary size of the bottom layer.

5. The confectionary display apparatus of claim 1, wherein the base includes a hexagonal shape.

6. The confectionary display of claim 1, wherein the one or more first, second, and third insertion components each include a stick and a circular base wherein, the stick is positioned at a center of the circular base.

7. The confectionary display apparatus of claim 6, wherein a confection is insertable to the stick, and wherein the circular base is configured to hold the confection in place.

8. The confectionary display apparatus of claim 6, wherein the circular base is attached at an angle to one of the top, one or more middle, or the bottom layer.

9. The confectionary display apparatus of claim 8, wherein the angle prevents the confection from slipping out of the stick.

10. A confectionary display apparatus comprising:
- a top layer, wherein
  - the top layer is coupled to one or more first insertion components, and wherein
  - one or more first confectionaries are insertable to the one or more first insertion components;
- one or more middle layers, wherein
  - the one or more middle layers are coupled to one or more second insertion components, and wherein
  - one or more second confectionaries are insertable to the one or more second insertion components;
- a bottom layer, wherein
  - the bottom layer is coupled to one or more second insertion components, wherein
  - one or more third confectionaries are insertable to the one or more third insertion components, and wherein
  - a primary size of the top layer is less than one or more secondary sizes of the one or more middle layers, and wherein the one or more secondary sizes of the one or more middle layers are less than a tertiary size of the bottom layer;
- a removable display component coupled to the top layer, wherein the display component is configured to receive one or more labels; and
- a base, wherein the base is coupled to the top, one or more middle and bottom layers with a shaft, and wherein the base includes a hexagonal shape.

11. The confectionary display apparatus of claim 10, further comprising:
- an attachable label display.

12. The confectionary display apparatus of claim 11, wherein the attachable label display is insertable to the top layer, the one or more middle layers, or the bottom layer.

13. A confectionary display apparatus comprising:
- a top layer, wherein
  - the top layer is coupled to one or more first insertion components, and wherein
  - one or more first confectionaries are insertable to the one or more first insertion components;
- one or more middle layers, wherein
  - the one or more middle layers are coupled to one or more second insertion components, and wherein
  - one or more second confectionaries are insertable to the one or more second insertion components;
- a bottom layer, wherein
  - the bottom layer is coupled to one or more third insertion components,
  - wherein one or more third confectionaries are insertable to the one or more third insertion components, and wherein a primary size of the top layer is less than one or more secondary sizes of the one or more middle layers, and wherein the one or more secondary sizes of the one or more middle layers are more than a tertiary size of the bottom layer;

a removable display component coupled to the top layer, wherein the display component is configured to receive one or more labels; and a base, wherein the base is coupled to the top, one or more middle and bottom layers with a shaft, and wherein the base includes a hexagonal shape.

14. A confectionary transportation system comprising:

a confectionary display apparatus, wherein the confectionary display apparatus comprises:

a top layer, wherein the top layer is coupled to one or more first insertion components, and wherein one or more first confectionaries are insertable to the one or more first insertion components;

one or more middle layers, wherein the one or more middle layers are coupled to one or more second insertion components, and wherein one or more second confectionaries are insertable to the one or more second insertion components;

a bottom layer, wherein the bottom layer is coupled to one or more second insertion components, and wherein one or more third confectionaries are insertable to the one or more third insertion components;

a removable display component coupled to the top layer, wherein the display component is configured to receive one or more labels;

a base, wherein the base is coupled to the top, one or more middle and bottom layers with a shaft; and a protective cover, wherein the protective cover is attachable to the base, the protective cover contains a portion that is complementary in shape to the top layer, the one or more middle layers, and the bottom layer, and wherein the protective cover includes a shape that encompasses the removable display component, the top, one or more middle layers, and bottom layers.

15. The confectionary transportation system of claim 14, wherein the protective cover is transparent.

16. The confectionary transportation system of claim 14, wherein the complementary shape includes a cone shape.

17. The confectionary transportation system of claim 14, wherein the complementary shape includes a sphere shape.

18. The confectionary transportation system of claim 14, wherein an external surface of the protective cover includes a three-dimensional hexagonal shape.

* * * * *